US006901864B2

(12) United States Patent
Helander

(10) Patent No.: US 6,901,864 B2
(45) Date of Patent: Jun. 7, 2005

(54) METHOD FOR SPEED COMPENSATION OF A SHAPED CHARGE JET, AND MISSILE

(75) Inventor: Jyrki Helander, Eskilstuna (SE)

(73) Assignee: Saab AB, Linköping (SE)

( * ) Notice: Subject to any disclaimer, the term of this patent is extended or adjusted under 35 U.S.C. 154(b) by 0 days.

(21) Appl. No.: 10/363,383

(22) PCT Filed: Sep. 3, 2001

(86) PCT No.: PCT/SE01/01867

§ 371 (c)(1),
(2), (4) Date: Jul. 2, 2003

(87) PCT Pub. No.: WO02/21070

PCT Pub. Date: Mar. 14, 2002

(65) Prior Publication Data

US 2004/0094060 A1 May 20, 2004

(30) Foreign Application Priority Data

Sep. 4, 2000 (SE) ..... 0003107

(51) Int. Cl.[7] ..... F42C 13/00
(52) U.S. Cl. ..... 102/211
(58) Field of Search ..... 102/211, 212, 102/213, 214; 244/3.21, 3.22, 3.15, 3.2

(56) References Cited

U.S. PATENT DOCUMENTS

| | | | | | |
|---|---|---|---|---|---|
| 3,732,818 | A | | 5/1973 | Thomanek | 102/306 |
| 4,262,596 | A | * | 4/1981 | Allier et al. | 102/476 |
| 4,374,495 | A | * | 2/1983 | Thomanek | 102/476 |
| 4,693,182 | A | | 9/1987 | Winblad | 102/476 |
| H000345 | H | * | 10/1987 | Williamsen et al. | 102/476 |
| 5,235,916 | A | * | 8/1993 | Winger | 102/475 |
| 5,275,355 | A | * | 1/1994 | Grosswendt et al. | 244/3.22 |
| 5,631,442 | A | | 5/1997 | Becker et al. | |
| 6,279,478 | B1 | * | 8/2001 | Ringer et al. | 102/213 |
| 6,393,991 | B1 | * | 5/2002 | Funston et al. | 102/476 |

FOREIGN PATENT DOCUMENTS

| | | | |
|---|---|---|---|
| DE | 977835 | | 6/1971 |
| DE | 3529897 | A1 | 3/1987 |
| DE | 3605579 | C1 | 5/1987 |
| DE | 3216142 | | 6/1988 |
| DE | 19516341 | A1 | 11/1996 |
| DE | 3150153 | C1 | 5/1998 |
| DE | 19813376 | A1 | 9/1999 |
| GB | 2006400 | A | 5/1979 |
| GB | 2006935 | A | 5/1979 |
| GB | 2149066 | A | 6/1985 |
| GB | 2170888 | | 8/1986 |
| SE | 450416 | | 6/1987 |

* cited by examiner

*Primary Examiner*—Stephen M. Johnson
(74) *Attorney, Agent, or Firm*—Venable LLP; Eric J. Franklin

(57) ABSTRACT

The present invention relates to a method for attacking a target by means of a missile (1) with at least one shaped charge, the direction of action of which differs from the direction of flight of the missile, and to a missile (1) comprising at least one shape charge (2) arranged to act in a direction (4) that differs from the direction of flight (5) of the missile. The shaped charge jet is corrected for the speed of the missile (1). According to the invention, the correction of the shaped charge jet is adjustable, whereby the lethality of the missile can be achieved within a wide range of speeds of the missile.

17 Claims, 2 Drawing Sheets

METHOD FOR SPEED COMPENSATION OF A SHAPED CHARGE JET, AND MISSILE

Figure 1:
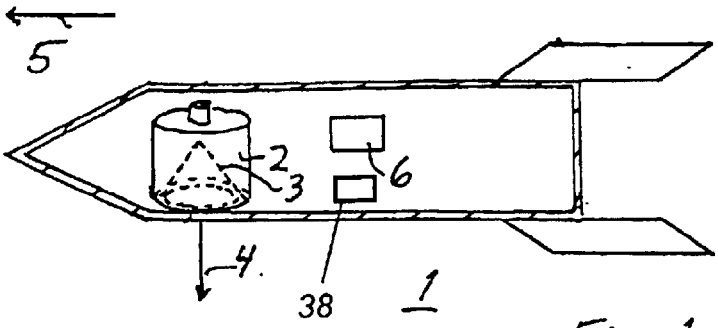

The present invention relates to a method for attacking a target by means of a missile with at least one shaped charge, the direction of action of which differs from the direction of flight of the missile, in which the jet of the shaped charge is corrected for the speed of the missile. The invention also relates to a missile comprising at least one shaped charge arranged to act in a direction that differs from the direction of flight of the missile, which shaped charge is provided with a correction device for correcting the jet of the shaped charge based on the different directions of movement of the missile and the shaped charge jet. A missile according to the above is well suited, for example, for attacking the weaker parts of a tank, that is the upper side.

In GB 2 006 400 and GB 2 006 935 the introduction of speed compensation of a shaped charge jet with a direction of action which differs from the direction of flight of the missile is already known. The speed compensation that is introduced is of the same order of magnitude irrespective of the speed of the missile when it reaches the target. Such speed compensation achieves its objectives in the case when the speed of the missile in the direction of flight remains within a narrow range of speeds for which the speed compensation has been designed. If, however, the missile is designed to approach a target with changing speeds in the direction of flight, its lethality will be greatly lessened outside this narrow range of speeds.

The object of the present invention is to achieve a method that provides the missile with great lethality within a wide range of speeds, and a missile that has great lethality within a wide range of speeds.

The object of the invention is achieved by a method characterized in that the correction of the shaped charge jet is designed to be adjustable, and by a missile characterized in that the correction device of the missile is designed to be able to adjust the correction of the shaped charge jet. By making the speed compensation adjustable, the correction of the missile's shaped charge jet is adjusted to the speed of the missile, and good lethality is achieved within a wide range of speeds of the missile.

According to an advantageous embodiment, the speed of the missile is measured during its flight towards the target, and the correction of the shaped charge jet is carried out based on the measured speed of the missile. The speed of the missile can suitably be obtained by measuring its acceleration and integrating. The correction can be carried out in one or more steps during the flight of the missile. Alternatively, the correction can be carried out continuously during the flight of the missile. The demands for precision of correction, reliability, cost, etc, can determine the correction method.

According to another advantageous method, the correction is carried out in the missile's launcher before the missile is launched, based on information concerning, among other thing, the distance to the target. The method is based on knowing the missile's speed pattern relatively well in advance and therefore being able to pre-set the correction that applies for the speed of the missile when it reaches the target, as the distance to the target is known. The speed of the missile does not therefore need to be measured in this method. In order to achieve a more reliable correction, further information can be provided, such as information about the speed of the target, temperature of the missile or of the launcher, wind conditions or special characteristics of the weapon.

The correction device incorporated in the missile can be designed in many ways in order to achieve the intended correction of the shaped charge jet of the missile. Particularly recommended are the introduction of a movable initiation point, the incorporation of an external movable mask, the division of the shaped charge into two parts that can move in relation to each other, the incorporation of a movable shaped charge cone, the incorporation of a waveguide arranged in the shaped charge, which waveguide is designed with a cavity within which an element can be moved.

Movements of the correction device can similarly be achieved in various ways. Particularly recommended are the introduction of one or more electric motors arranged in the missile, such as stepping motors, the incorporation of a propulsive element such as gunpowder, the incorporation of magnets or the incorporation of pneumatic or hydraulic systems.

Other further developments will be apparent from the patent claims attached to the description.

In the following, the invention will be described in greater detail in exemplified form, with reference to the attached figures, in which:

FIG. 1 shows schematically an example according to the invention of a missile with speed compensation of the shaped charge jet.

FIGS. 2*a*–2*e* show schematically fire different ways of achieving adjustable speed compensation of the jet of a shaped charge.

Figure 3:
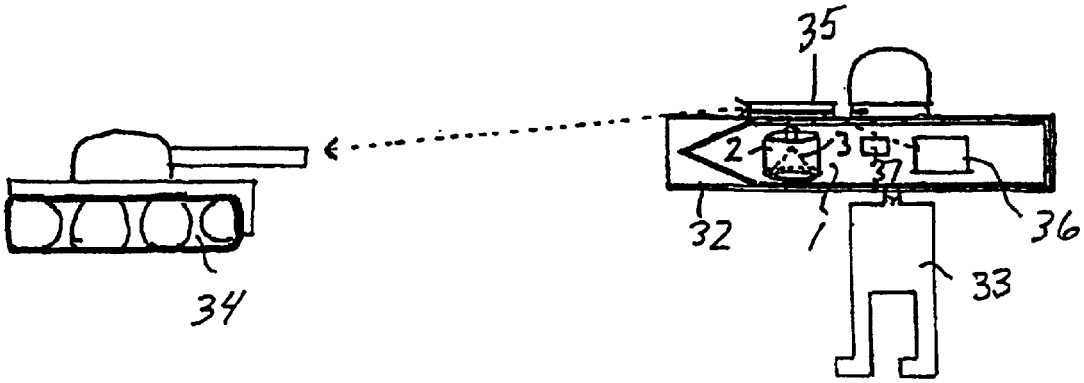

FIG. 3 shows a further example according to the invention of a missile with speed compensation of the shaped charge jet, in which the missile is shown in an associated launcher and is directed towards a target.

The missile 1 shown in FIG. 1 comprises a shaped charge 2 with a shaped charge cone 3 directed so that the shaped charge jet leaves the missile 1 in a direction 4 essentially at right angles to the direction of flight 5 of the missile. In the missile 1 there is a device 6 which records the speed of the missile during the flight. The speed-recording device can, for example, consist of an accelerometer with signal integration. Another alternative for measuring the speed is to use a gyro or turbine.

Figure 2A:
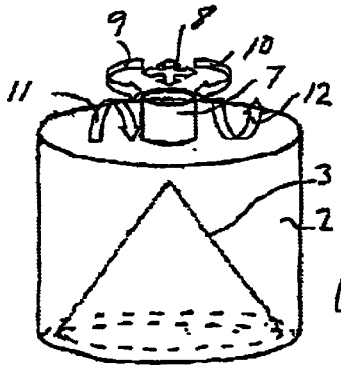

FIG. 2*a* shows a first example of adjustable speed compensation. For the shaped charge 2 in this case, the adjustment is achieved by means of the initiation point 7 of the shaped charge being arranged to be able to be moved above the tip of the shaped charge cone 3. Arrows 8–12 indicate the possible movements that the initiation point 7 can make.

Figure 2B:
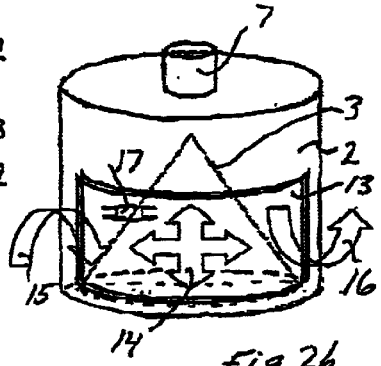

FIG. 2*b* shows another example of adjustable speed regulation. In this case, an external mask 13 is arranged on the outside of the shaped charge 2. By moving the mask 13 relative to the shaped charge 2 in directions that are indicated by the arrows 14–17, adjustment of the direction of the shaped charge jet is achieved.

Figure 2C:
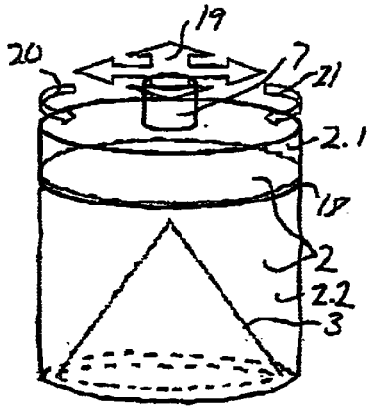

In the embodiment shown in FIG. 2*c*, the shaped charge 2 is divided with two parts 2.1 and 2.2 with a dividing plane 18 above the shaped charge cone 3. Arrows 19–21 indicate how the partial shaped charge 2.1 can be moved in relation to the partial charge 2.2.

Figure 2D:
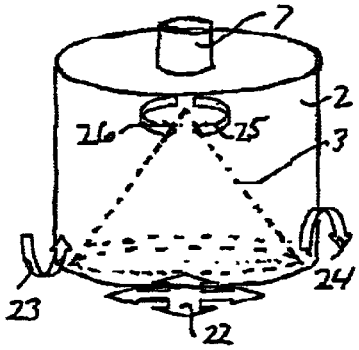

The embodiment shown in FIG. 2*d* has a shaped charge cone 3 that can be moved within the shaped charge 2. Arrows 22–26 indicate how the shaped charge cone can be moved.

Figure 2E:
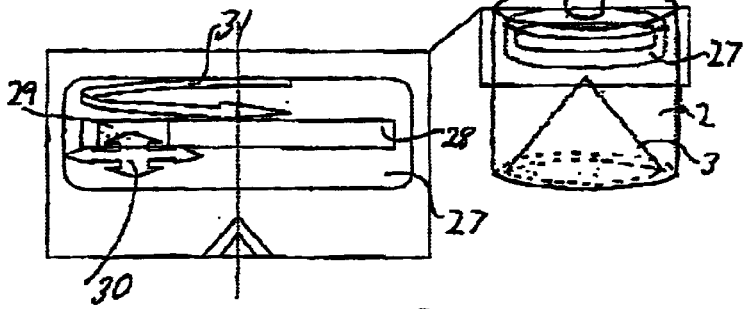

In the proposed embodiment according to FIG. 2*e*, the waveguide 27 of the shaped charge is used. The waveguide is designed with a cavity 28 with a movable element 29 inside the cavity. The movement of the element 29 is determined by the speed of the missile. The function of the element 29 is to locally increase the shock-wave speed in order thereby to create a penetration of the detonation front in the waveguide. The asymmetry created by the element 29 is expected to give a speed-compensated shaped charge jet. Arrows 30 and 31 indicate how the element 29 and the waveguide 27 can move.

It can be pointed out here that the embodiments according to the FIGS. 2*a*–2*d* also normally comprise waveguides. As these waveguides have no particular effect on the adjustable correction of the shaped charge jet, they have been omitted in the figures.

The movements described with reference to the FIGS. 2*a*–2*e* can be achieved in many ways indicated by 38 in FIG. 1. For example, an electric motor can be used, and for correction in steps a, stepping motor is particularly suitable. It is also possible to use some form of propulsive element, for example a powder charge. Movement can also be achieved by means of (electro-) magnets. Other methods of achieving movement can be based on pneumatics or hydraulics.

In the following, a further embodiment of the missile 1 is described, where the correction that is to be introduced into the missile's shaped charge jet is set before launching, that is when the missile is inside the launcher 32 from which it is to be fired.

FIG. 3 shows an operator 33 who is aiming the weapon at a target 34 in the form, for example, of a tank. The operator uses a range-finder 35 arranged on the outside of the launcher 32. The missile 1 is inside the launcher 32 and comprises a shaped charge 2. The range-finder 35, which can be independent, provides information about the distance to the target 34 and may also measure the target's speed. There can be equipment in the missile 1 or its launcher 32 for measuring temperature. A wind-speed motor and a timer can also be included. In the figure, the equipment for measuring temperature and wind and the timer are shown contained in a common housing 36.

The weapon works as follows. When the operator aims at the target, information is obtained about at least the distance to the target. Based on the distance information and any other information, for example as above, the speed of the missile when it approaches the target can be estimated and hence the correction of the shaped charge can be adjusted before launching. The above applies on the assumption that the speed of the missile as a function of the distance covered is known. The processing of the available information and the estimation of the speed can be carried out in a processing unit 37 housed in the missile 1. When the missile leaves the launcher, the shaped charge is thus adjusted to provide the optimal lethality.

The invention is not limited to the embodiments described above, but can be modified within the scope of the following patent claims and invention concept.

What is claimed is:

1. A method for attacking a target by means of a missile with at least one shaped charge, a direction of action of which differs from a direction of flight of the missile, in which a jet of the shaped charge is corrected for a speed of the missile, the method comprising:

adjusting the shaped charge jet relative to the shaped charge;

measuring a speed of the missile during flight of the missile towards the target; and carrying out the correction of the shaped charge jet based on the measured speed of the missile.

2. A method for attacking a target by means of a missile with at least one shaped charge, a direction of action of which differs from a direction of flight of the missile, in which a jet of the shaped charge is corrected for a speed of the missile, the method comprising:

adjusting the shaped charge jet relative to the shaped charge; and measuring the speed of the missile by measuring its acceleration and integrating.

3. A method for attacking a target by means of a missile with at least one shaped charge, a direction of action of which differs from a direction of flight of the missile, in which a jet of the shaped charge is corrected for a speed of the missile, the method comprising:

adjusting the shaped charge jet relative to the shaped charge; and carrying out the correction for the speed of the missile in one or more steps during the flight of the missile.

4. A method for attacking a target by means of a missile with at least one shaped charge, a direction of action of which differs from a direction of flight of the missile, in which a jet of the shaped charge is corrected for a speed of the missile, the method comprising:

adjusting the shaped charge jet relative to the shaped charge; and carrying out the correction for the speed of the missile continuously during the fight of the missile.

5. A method for attacking a target by means of a missile with at least one shaped charge, a direction of action of which differs from a direction of flight of the missile, in which a jet of the shaped charge is corrected for a speed of the missile, the method comprising:

carrying out the correction in a launcher of the missile before the missile is launched, based on information about a distance to the target; and adjusting the shaped charge jet relative to the shaped charge.

6. The method according to claim 5, the correction is also based on at least one of the following: information about the speed of the target, temperature in the missile or launcher, wind conditions or characteristics of the weapon.

7. A missile, comprising:

at least one shaped charge arranged to act in a direction that differs from a direction of flight of the missile, the shaped charge comprising a correction device for correcting a jet of the shaped charge based on different directions of movement of the missile and the shaped charge jet, wherein the correction device is operative to adjust the correction of the shaped charge jet relative to the shaped charge; and one or more electric motors operative to achieve movements of the correction device.

8. The missile according to claim 7, wherein the one or more electric motors comprise stepping motors.

9. A missile, comprising:

at least one shaped charge arranged to act in a direction that differs from a direction of flight of the missile, the shaped charge comprising a correction device for correcting a jet of the shaped charge based on different directions of movement of the missile and the shaped charge jet, wherein the correction device is operative to adjust the correction of the shaped charge jet relative to the shaped charge; and one or more magnets operative to achieve movements of the correction device.

10. A missile, comprising:

at least one shaped charge arranged to act in a direction that differs from a direction of flight of the missile, the shaped charge comprising a correction device for correcting a jet of the shaped charge based on different directions of movement of the missile and the shaped charge jet, wherein the correction device is operative to adjust the correction of the shaped charge jet relative to the shaped charge; and pneumatic or hydraulic systems operative to achieve movements of the correction device.

11. A missile, comprising:

at least one shaped charge arranged to act in a direction that differs from a direction of flight of the missile, the shaped charge comprising a correction device for correcting a jet of the shaped charge based on different directions of movement of the missile and the shaped charge jet, wherein the correction device is operative to adjust the correction of the shaped charge jet relative to the shaped charge; and a speed-measuring device arranged in the missile to measure a speed of the missile during flight.

12. The missile according to claim 11, wherein the correction device comprises an initiation point for the shaped charge, wherein the initiation point is movable to adjust the correction of the shaped charge jet.

13. The missile according to claim 11, further comprising a propulsive element operative to achieve the movements of the correction device.

14. A missile, comprising:

at least one shaped charge arranged to act in a direction that differs from a direction of flight of the missile, the shaped charge comprising a correction device for correcting a jet of the shaped charge based on different directions of movement of the missile and the shaped charge jet, wherein the correction device is operative to adjust the correction of the shaped charge jet relative to the shaped charge; and a range-finding device arranged to measure a distance to a target before launching, wherein the correction device pre-sets a correction of the shaped charge jet based at least on the distance.

15. The missile according to claim 14, wherein the correction device comprises an initiation point for the shaped charge, wherein the initiation point is movable to adjust the correction of the shaped charge jet.

16. The missile according to claim 14, further comprising a propulsive element operative to achieve the movements of the correction device.

17. A missile, comprising:

at least one shaped charge arranged to act in a direction that differs from a direction of flight of the missile, the shaped charge comprising a correction device for correcting a jet of the shaped charge based on different directions of movement of the missile and the shaped charge jet, wherein the correction device is operative to adjust the correction of the shaped charge jet relative to the shaped charge; and a propulsive element operative to achieve the movements of the correction device, wherein the propulsive element comprises gunpowder.

* * * * *